US011325823B2

(12) United States Patent
Viladot Gene

(10) Patent No.: US 11,325,823 B2
(45) Date of Patent: May 10, 2022

(54) SYSTEM OF FUEL VAPOR RECOVERY AND USE

(71) Applicant: Fuel Management Technologies, S.L., Barcelona (ES)

(72) Inventor: Ricard Viladot Gene, Barcelona (ES)

(73) Assignee: Fuel Management Technologies, S.L., Barcelona (ES)

( * ) Notice: Subject to any disclaimer, the term of this patent is extended or adjusted under 35 U.S.C. 154(b) by 0 days.

(21) Appl. No.: 17/181,743

(22) Filed: Feb. 22, 2021

(65) Prior Publication Data

US 2021/0171332 A1 Jun. 10, 2021

Related U.S. Application Data

(63) Continuation of application No. 16/315,418, filed as application No. PCT/ES2016/070506 on Jul. 6, 2016, now Pat. No. 10,974,952.

(51) Int. Cl.
*B67D 7/04* (2010.01)

(52) U.S. Cl.
CPC ..... *B67D 7/049* (2013.01); *B67D 7/04* (2013.01); *B67D 7/048* (2013.01); *B67D 2007/0494* (2013.01)

(58) Field of Classification Search
CPC ..... B67D 7/04; B67D 7/049; B67D 7/048; B67D 2007/0494
See application file for complete search history.

(56) References Cited

U.S. PATENT DOCUMENTS

| | | | | |
|---|---|---|---|---|
| 2,379,215 A * | 6/1945 | Brinkmann | B65D 90/30 422/10 |
| 3,266,262 A ‡ | 8/1966 | Moragne | B01D 5/0081 62/46 |
| 5,006,138 A ‡ | 4/1991 | Hewitt | B01D 5/0054 62/48 |
| 5,017,240 A * | 5/1991 | Brown | B01D 5/0027 134/10 |
| 5,220,799 A * | 6/1993 | Lievens | B01D 5/0081 220/88.3 |
| 10,974,952 B2 | 4/2021 | Viladot Gene | |

FOREIGN PATENT DOCUMENTS

WO 2009/013544 A2 1/2009

* cited by examiner
‡ imported from a related application

*Primary Examiner* — Jason K Niesz
(74) *Attorney, Agent, or Firm* — Shook, Hardy & Bacon LLP

(57) ABSTRACT

The systems and methods of fuel vapor recovery and use comprise a cryogenic condensation module and a fuel tank of a service station. The cryogenic condensation module comprises a cryogenic vaporizer that lowers the temperature of fuel vapors via condensation. The cryogenic condensation module also comprises a processing element that processes the fuel vapors that have not been condensed via the cryogenic vaporizer. The fuel tank is connected to the cryogenic condensation module by a ventilation pipe and a return pipe. The ventilation pipe is capable of displacing the fuel vapors to the cryogenic condensation module. The return pipe is capable of returning condensed fuel vapors to the fuel tank.

20 Claims, 2 Drawing Sheets

SYSTEM OF FUEL VAPOR RECOVERY AND USE

CROSS-REFERENCE TO RELATED APPLICATIONS

This application claims priority to U.S. application Ser. No. 16/315,418, filed on Jan. 4, 2019, entitled "SYSTEM OF FUEL VAPOR RECOVERY AND USE"; which claims priority under 35 U.S.C. § 365 to PCT/ES2016/070506, filed on Jul. 6, 2016, entitled "SYSTEM FOR THE RECOVERY AND USE OF VAPOURS FROM FUELS," the entirety of the aforementioned applications are incorporated by reference herein.

BACKGROUND

Conventionally, when a fuel supplying tanker truck that carries a load reaches a delivery site, for example, a service station, the tank is connected by a hose to an underground or overhead fuel storage tank.

The transfer of the fuel may be carried out by gravity or may be pressure assisted. The fuel passes from the tank through a system of ducts to an underground or overhead storage tank, from where the users can access the fuel in the service stations through a separate assembly of ducts.

A service station with moderate activity that comprises approximately six distribution terminals will receive at least one tanker truck per day, while a larger service station, for example, a highway service station can receive about five tanker trucks per day. As a result, this fuel supply process from a tanker truck to the tank is constant.

The space above the level of fuel in the storage tank contains fuel vapors, almost always at a saturated level. When filling the fuel storage tank with the delivery load, these vapors are necessarily displaced and ventilated to the atmosphere through pipes. The unloading of said vapors into the atmosphere is not only costly, but also harmful to the environment and may create a risk of explosion, in addition to the inhalation of or other contact with the fuel vapors that may be dangerous to one's health.

To reduce the effect of this vapor unload, modification of the ventilation system is known so that the vapors displaced during unloading are returned to the storage tank. However, it has been shown in practice that the known systems of fuel vapor recovery are not very efficient. It is common that the fuel recovered is hardly more than 1 or 2 liters per tank, compared to the 35,000 liters of a load from a normal delivery.

The known systems for fuel vapor recovery have high energy consumption, which is negative. Another disadvantage of the systems for vapor recovery of the prior art is that they generate an unacceptable load of highly explosive vapors. In practice, it is likely that a substantial amount of vapors is dispersed through ventilation grilles, and therefore, further contributes to environmental pollution.

It is also possible that, due to the high pressure of vapors, a large part thereof will be unloaded into the atmosphere through a pressure valve.

The system of fuel vapor recovery described in document WO 2009/013544, which comprises the characteristics indicated in the preamble of claim 1, is known. This system comprises a cryogenic cooling system with two-step coalescence to condense the vapors.

Therefore, there is a need to provide an improved system to effectively recover the fuel vapors and prevent the escape thereof into the atmosphere at service stations, and in particular, to improve vapor condensation.

There is also a need for a simplified system that can be easily assembled at existing service stations.

BRIEF SUMMARY

The present invention relates to a system of fuel vapor recovery and use in a fuel service station and oil terminals.

The system of recovery of the invention resolves the aforementioned drawbacks and has other advantages, which are described below.

The system of fuel vapor recovery and use according to the present invention comprises a condensation module that can connect to a fuel tank of a service station by means of ventilation pipe, through which the fuel vapors are displaced to the condensation module, wherein they are condensed and processed, further comprising the condensation module and a return pipe for the vapors that are already liquid condensed to the fuel tank for the use and sale thereof, which is characterized in that said condensation module comprises a cryogenic vaporizer that lowers the temperature of the vapors by condensing them and a processing element that processes the vapors that have not been condensed in said vaporizer.

According to a preferred embodiment, said processing element is a coalescing mesh.

Advantageously, said condensation module further comprises a collection tank for the condensed and processed vapors and a shunt arranged between the ventilation pipe and an outlet pipe.

The system of fuel vapor recovery and use according to the present invention further comprises preferably at least one safety valve arranged in said ventilation pipe.

The system of fuel vapor recovery according to the present invention further comprises advantageously a compression module that comprises at least one compressor connected to the cryogenic vaporizer.

Moreover, said outlet pipe may comprises a vent valve and said return pipe may comprise a solenoid valve to automatically unload the condensed and processed fuel to the tank for the use and sale thereof.

Said return pipe further comprises preferably at least one manual valve to manually unload the condensed fuel to the tank.

The system according to the present invention makes it possible to process the water present in the outer air and atmosphere inside the fuel tanks of the service station. The presence of water in the environment is common in some countries where the humidity level may reach 100%.

The system according to the present invention establishes two modules at different temperatures in the cryogenic condensation chamber, which allows fractionated condensation of one part of the water vapor and of another part of the most volatile elements of the fuel vapors.

Advantageously, said first and second modules of said cryogenic vaporizer and said processing element are arranged in series for the bidirectionality of the vapors and the air.

The system according to the present invention makes it possible to process the water evaporated in the environment and thus separately work on the water vapor and the fuel vapors to be treated in the cryogenic condensation chamber. The presence of water in the condensation chamber would drastically modify the performance of the system.

The inclusion of valves and the shunt make it possible to improve and optimize safety and performance of the system.

BRIEF DESCRIPTION OF THE DRAWINGS

For the purpose of helping to make the foregoing description more readily understandable, it is accompanied by a set of drawings which, schematically and by way of illustration and not limitation, represent an embodiment.

DETAILED DESCRIPTION

Figure 1:
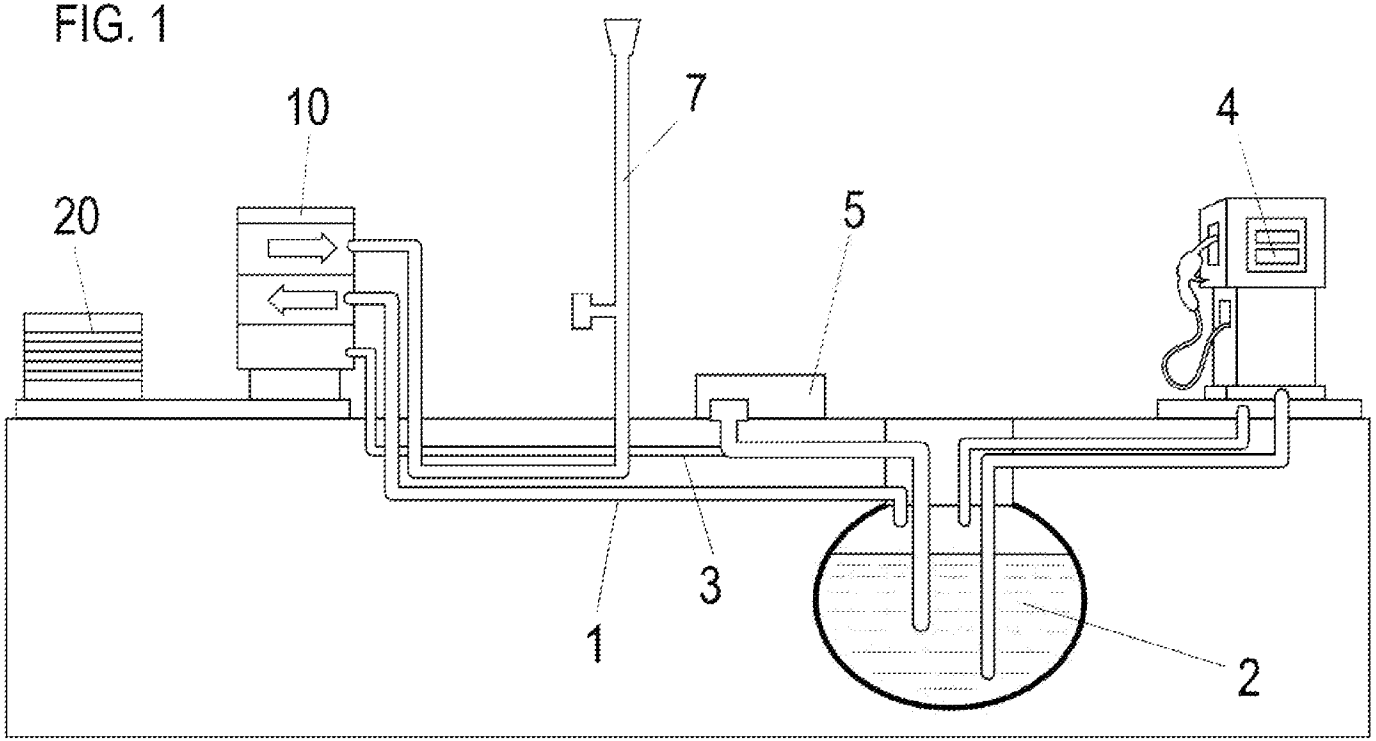
FIG. 1 is a schematic view of a service station that includes the system of vapor recovery according to the present invention.
Figure 2:
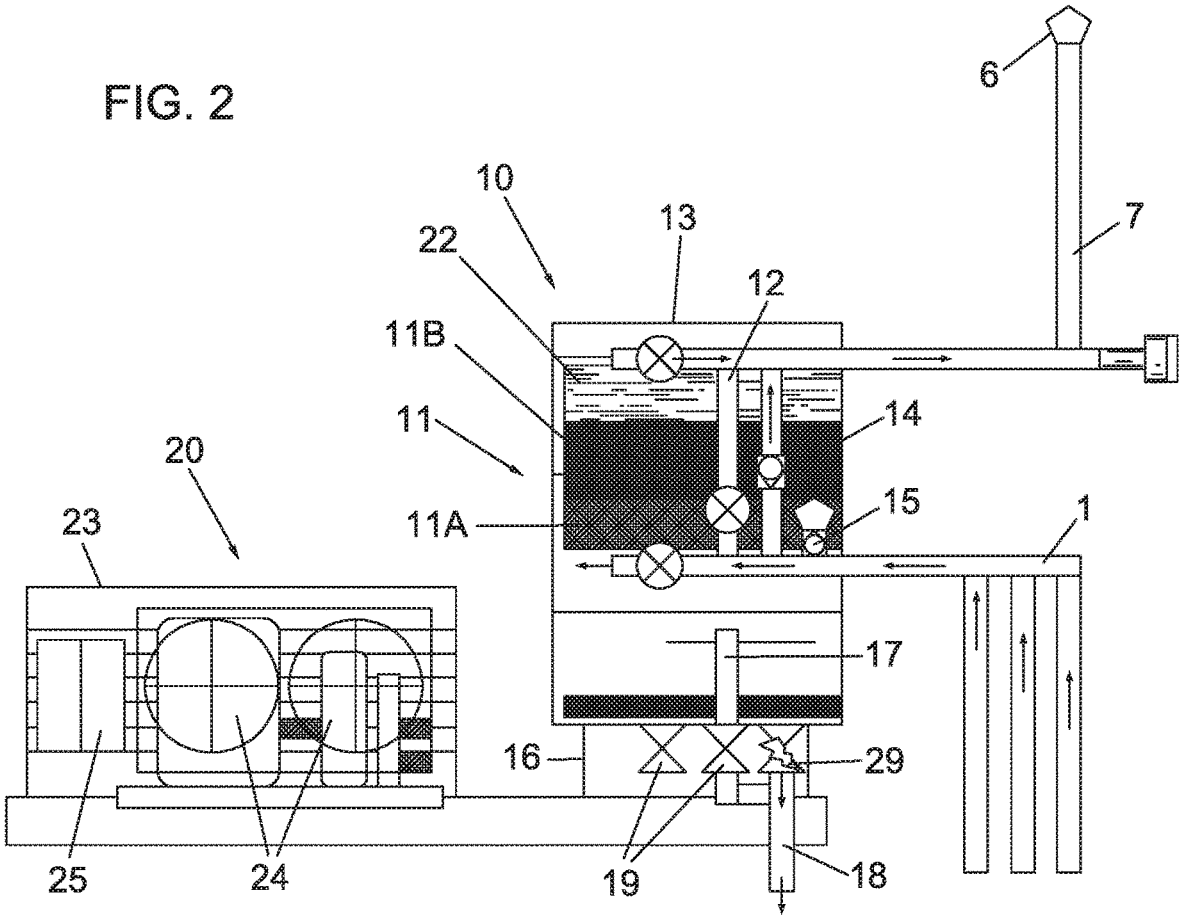
FIG. 2 is a schematic view of the system of vapor recovery according to the present invention.

FIG. 1 schematically shows a service station that includes the system of vapor recovery and use according to the present invention.

The system according to the present invention is installed on a ventilation pipe 1 of a fuel tank 2 at a service station. This ventilation pipe 1 can have different shapes and different components due to the type of installation with which they must comply according to the laws of each country. These types of ventilation pipes do not affect the installation of the system according to the present invention.

A fuel dispenser 4 connected to the fuel tank 2, through which the user loads their vehicle with fuel, is also installed at the service station. Moreover, the service station further comprises a fuel supply base 5 connected to the tank 2, wherein a tanker truck is placed to supply fuel to said tank 2.

The system according to the present invention further comprises a return pipe 3 of the recovered product to the fuel tank 2 of the service station.

In particular, the system according to the present invention comprises two modules installed on the same base plate: a cryogenic condensation module 10 and a compression module 20.

As seen in FIG. 1, the cryogenic condensation module 10 is connected to the tank 2 by means of said ventilation pipe 1, such that the vapors from the tank 2 enter the condensation module 10 by means of said ventilation pipe 1.

The condensation module 10 comprises a sealed chamber 13, wherein the vapors are processed, the temperature thereof being lowered by means of a cryogenic vaporizer 11.

The cryogenic vaporizer 11 comprises two different modules that process, in a first step, the possible moisture that the vapors that pass through it may contain, and in a second step, the fuel vapors previously cleaned of the possible moisture.

The first module of the cryogenic vaporizer 11A makes it possible to process the present water coming from both the outer air and the atmosphere inside the fuel tanks of the service station, eliminating the existence of water in the fuel vapors, which will be processed by means of condensation and liquefaction in a second module of the cryogenic vaporizer 11B for the use and sale thereof.

In this module 10, a safety shunt 12 is installed by means of manual valves. This shunt 12 makes it possible to prevent the passage of the vapors through the condensation module 10 in order to carry out installation, maintenance and repair work without affecting the operation of the service station. This shunt 12 also regulates the passage of vapors to the inside of the chamber 13, as well as the outlet thereof from the cryogenic condensation chamber 13.

In the shunt, there is a safety path 14 that acts in the case of mechanical blockage in the condensation chamber 13 when the flow of vapors goes from the tank 2 of the station to a vent valve 6 arranged on the end of an outlet pipe 7. This safety path 14 makes it possible to ensure the outlet of the vapors in any case of blockage.

The condensation module 10 further comprises a safety valve 15 that ensures that the air is taken from the outside in the case of blockage of the condensation chamber 13 and thus allows for the perfect operation of the service station when a depression is created in the ventilation during the sales processes of the fuel.

Arranged in the lower part of the condensation chamber 13 is a collection tank 16 where the liquefied fuel resulting from the condensation of the vapors is stored. This collection tank 16 contain a measuring system that indicates the amount of existing fuel. This measuring system makes it possible to obtain information about the working conditions of the system and see the particular features of each installation and optimize efficiency according to the specific needs of the installation.

Arranged in the lower part of the condensation chamber 13 is also an overfill safety pipe 17 that makes it possible to remove the liquid that passes from a maximum level through the return pipe 18 to the main tank of the station.

Arranged at the bottom of the tank are also manual valves 19 that allow for the manual extraction of the product of this collection tank 16 for the measurement and checking thereof by the technicians and qualified personnel.

Moreover, placed in this collection tank 16 is a solenoid valve 29 controlled by management means that automatically unload the fuel existing in this collection tank 16, according to the configuration, to tank 2 of the station for the use and sale thereof.

Arranged in said chamber 13 is the aforementioned cryogenic vaporizer 11, placed so that the vapors pass through it, radically changing the temperature thereof instantly. This vaporizer 11 is controlled and managed from the compression module 20. This cryogenic vaporizer 11 condenses the vapors, liquefying the fuel contained therein, precipitating them by gravity to the collection tank 16.

Incorporated into the cryogenic vaporizer 11 is a coalescing mesh 22 in series with said first and second modules 11A and 11B, which makes it possible to process the vapors that, due to the rate at which the vapor passes, they have not been condensed in the vaporizer 11. This element makes it possible to conglomerate the remaining molecules in the vapors, as well as group together drops of fuel that will finally be precipitated to the collection tank 16, making the system more effective.

In the cryogenic vaporizer 11 and in the outlet of the condensation chamber, there are two temperature probes that indicate the temperature inside the chamber 13 that makes it possible to see the operation of the system and the efficiency thereof. The control means that govern the operation of the system require these temperature probes to manage the operating cycles and modulate the working temperatures.

The outer part of the chamber 13 is coated with an insulating element that allows for greater energy efficiency, as well as a protective ventilated wall that has two purposes: maintain the temperature of the outside of the chamber 13 as low as possible, creating an air current and protecting the chamber 13 from external effects, and mechanical protection.

The compression module 20 of the system according to the present invention is formed by a metal casing 23 separated from the condensation module 10 at a distance according to safety specifications and by classified areas.

Inside this casing 23, there is at least one compressor 24, along with mechanical devices needed to cool the cryogenic vaporizer 11 installed in the condensation module 10.

This compressor 24 is governed by control means 25. These control means 25 manage the operation of the compressor 24 according to the needs of the condensation chamber 13 that it obtains through the temperature probes arranged therein.

These control means 25 govern the parameters needed to prevent the blockage of the vaporizer 11 caused by ice, this feature being a safety measure and an element to control the creation of water in this system.

The control means 25 further control the volumes and recovery data of the system. These control means receive data from the condensation chamber 13, interpreting the product levels inside the collection tank 16, manage the fuel levels and direct the unloading of the system to the fuel tank 2 of the station, reporting all data to the database thereof.

The control means have an IP address connection that makes it possible to view this data via the Internet.

The system according to the present invention makes it possible to process the water present in the outer air and inside the fuel tanks of the service station. The presence of water in the environment is common in some countries where the humidity level may reach 100%.

Despite the fact that reference has been made to a specific embodiment of the invention, it is evident for the person skilled in the art that numerous variations and changes may be made to the recovery system described, and that all the aforementioned details may be substituted by other technically equivalent ones, without detracting from the scope of protection defined by the attached claims.

What is claimed is:

1. A system of fuel vapor recovery and use, the system comprising:

a fuel tank of a service station, the fuel tank connected to a cryogenic condensation module by a ventilation pipe and a return pipe, wherein the ventilation pipe displaces fuel vapors to the cryogenic condensation module, and wherein the return pipe returns condensed volatile elements of the fuel vapors to the fuel tank; and the cryogenic condensation module comprising:

a cryogenic vaporizer having a first module that fractionally condenses water vapors and a second module that fractionally condenses the volatile elements of the fuel vapors that are more volatile than the water vapors, wherein the first module and the second module are at different temperatures; and a processing element having a coalescing mesh, wherein the processing element processes the fuel vapors that have not been condensed via the cryogenic vaporizer, and wherein the coalescing mesh is positioned in a series with the first module and the second module.

2. The system of claim 1, wherein the cryogenic condensation module further comprises a collection tank for the fuel vapors that were condensed.

3. The system of claim 1, further comprising at least one safety valve arranged in the ventilation pipe.

4. The system of claim 1, wherein the return pipe comprises a solenoid valve that automatically unloads the condensed volatile elements to the fuel tank.

5. The system of claim 1, wherein the return pipe comprises at least one manual valve to manually unload the condensed volatile elements to the fuel tank.

6. The system of claim 1, wherein the first module and the second module are arranged in a series for bidirectionality of the fuel vapors and air that has enter the system from outside.

7. The system of claim 1, further comprising a collection tank that collects the fuel vapors that have been processed by the processing element.

8. The system of claim 1, further comprising a cryogenic compression module.

9. The system of claim 8, wherein the cryogenic compression module comprises at least one compressor connected to the cryogenic vaporizer.

10. The system of claim 1, further comprising a shunt arranged between the ventilation pipe and an outlet pipe.

11. The system of claim 10, the outlet pipe comprises a vent valve.

12. The system of claim 10, wherein the shunt provides for regulation of the fuel vapors flowing into the cryogenic condensation module and outward via the outlet pipe, and wherein a valve of the shunt provides for the prevention of fuel vapors passing through the cryogenic condensation module for maintaining operation of the system during repair work.

13. A method of fuel vapor recovery and use comprising:

receiving, at a cryogenic condensation module comprising a cryogenic vaporizer and a processing element positioned in a series with a first module and a second module of the cryogenic vaporizer, fuel vapors comprising volatile elements and water vapors, wherein the fuel vapors were received from a fuel tank via a ventilation pipe;

fractionally condensing, via the first module of the cryogenic vaporizer, the water vapors;

fractionally condensing, via the second module of the cryogenic vaporizer, the volatile elements, wherein the first module and the second module are at different temperatures;

processing, via the processing element, the fuel vapors that have not been condensed via the cryogenic vaporizer; and returning the volatile elements that were condensed to the fuel tank via a return pipe.

14. The method of claim 13, wherein the processing element is a coalescing mesh.

15. The method of claim 13, wherein the cryogenic condensation module further comprises a collection tank for the fuel vapors that were processed via the processing element.

16. The method of claim 13, wherein the return pipe comprises a solenoid valve and a manual valve for returning the volatile elements that were condensed to the fuel tank.

17. The method of claim 13, further comprising:

collecting, via a collection tank, the fuel vapors that have been processed by the processing element; and determining a level inside the collection tank.

18. The method of claim 17, wherein the first module and the second module are arranged in a series for bidirectionality of the fuel vapors and air within the cryogenic vaporizer.

19. The method of claim 17, further comprising separating the water vapors and the volatile elements using at least one mesh.

20. A process for isolating volatile elements of fuel vapor for fuel recovery and use, the process comprising:

receiving fuel vapors at a cryogenic condensation module via a ventilation pipe connected to a fuel tank, the fuel vapors comprising water vapors and volatile elements, the cryogenic condensation module comprising:

a cryogenic vaporizer that lowers a temperature of fuel vapors via condensation, the cryogenic vaporizer having a first module and a second module; and a processing element positioned in a series with the first module and the second module of the cryogenic vaporizer;

fractionally condensing, via the first module, the water vapors;

fractionally condensing, via the second module, the volatile elements, wherein the first module and the second module are at different temperatures;

processing, via the processing element, the fuel vapors that have not been condensed; and returning the volatile elements that were condensed to the fuel tank via a return pipe.

* * * * *